US009132845B2

(12) United States Patent
Kraeling et al.

(10) Patent No.: US 9,132,845 B2
(45) Date of Patent: Sep. 15, 2015

(54) SYSTEM AND METHOD FOR COMMUNICATIONS IN A VEHICLE CONSIST

(75) Inventors: Mark Bradshaw Kraeling, Melbourne, FL (US); Jared Cooper, Melbourne, FL (US); Todd Goodermuth, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 410 days.

(21) Appl. No.: 13/493,278

(22) Filed: Jun. 11, 2012

(65) Prior Publication Data

US 2012/0316764 A1 Dec. 13, 2012

Related U.S. Application Data

(60) Provisional application No. 61/495,867, filed on Jun. 10, 2011.

(51) Int. Cl.
*G05D 1/00* (2006.01)
*B61L 15/00* (2006.01)

(52) U.S. Cl.
CPC ..... *B61L 15/0036* (2013.01)

(58) Field of Classification Search
USPC ..... 701/19, 117; 709/224
See application file for complete search history.

(56) References Cited

FOREIGN PATENT DOCUMENTS

EP 1065128 A1 * 1/2001 ..... B61L 15/00

* cited by examiner

*Primary Examiner* — Kim T Nguyen
(74) *Attorney, Agent, or Firm* — GE Global Patent Operation

(57) ABSTRACT

A method for communications in a vehicle consist (e.g., for managing network services among a plurality of networked locomotives or other vehicles in the consist) includes monitoring a first available device of a first locomotive (or other first vehicle) in the consist to determine an operational status of the first available device, and maintaining information of the operational status of the first available device in a database.

19 Claims, 6 Drawing Sheets

SYSTEM AND METHOD FOR COMMUNICATIONS IN A VEHICLE CONSIST

CROSS REFERENCE TO RELATED APPLICATIONS

This application claims priority to U.S. provisional application Ser. No. 61/495,867, filed Jun. 10, 2011, hereby incorporated by reference in its entirety.

FIELD OF THE INVENTION

Embodiments of the invention relate generally to data communications. Other embodiments relate to network communications in a vehicle consist.

BACKGROUND OF THE INVENTION

A vehicle "consist" is a group of vehicles that are mechanically coupled to travel together along a route. For example, a train is a type of vehicle consist comprising a group of rail vehicles coupled together to travel along a track. Similarly, a locomotive consist is a group of two or more locomotives that are coupled together, as part of a larger train or otherwise. Trains may have one or more locomotive consists. Locomotives in a locomotive consist include a lead locomotive and one or more trail locomotives. A train may have a lead consist, and may also have one or more remote consists positioned further back in the train. Alternatively or additionally, some trains may have single locomotives positioned within the train and separated from other locomotives by one or more non-locomotive rail cars (e.g., cargo or passenger cars).

In a locomotive consist, each locomotive includes a connection at each end of the locomotive to couple the power and brake systems of the locomotive to adjacent locomotives such that they function together as a single unit. Each locomotive is connected to subsequent locomotives via a port and jumper cable that includes twenty seven pins on each end. This cable is commonly referred to in the industry as a multiple unit cable or "MU" cable. Two or more of the locomotives in a consist may each include an on-board controller or other electronics. In certain cases, it may be desirable to link the on-board electronics together as a computer network, such that electronics of the lead locomotive in the consist can communicate with electronics of the trail locomotives. This intra-consist network may allow for inherent redundancies in locomotive electronics to be used to improve reliability of locomotives by allowing lead locomotives to utilize electronic equipment contained in trail locomotives of the same consist. It may be easier and more cost effective to use remote electronics in a trail locomotive than providing redundant equipment on each locomotive.

Communications in a vehicle consist have been realized using a number of methods. A first involves wireless communications between the vehicles in the consist using radio equipment. A second method involves running dedicated network cables between the linked locomotives in a consist. A third method involves Ethernet over MU communications between the vehicles in the consist, utilizing an existing locomotive MU cable bus that interconnects the lead locomotive and the trail locomotives. The MU cable bus is an existing electrical bus that is used in the locomotive consist for transferring non-network control information between the lead locomotive and the trail locomotives. (MU "cable bus" refers to the MU cable jumper that actually interconnects adjacent locomotives and/or to the internal electrical system that connects the cable jumper to internal locomotive electronics and the MU ports on either end of a locomotive.)

Although systems exist for network communications in vehicle consists, existing systems may not provide reliable or efficient methods for establishing such communications. Accordingly, it may be desirable to have a vehicle consist communication system and/or method that differ in function from those systems that are currently available.

BRIEF DESCRIPTION OF THE INVENTION

An embodiment relates to a communication method for a consist comprising a plurality of vehicles. The method comprises linking the plurality of vehicles to establish a data network. For example, linking may include communicating over a communications path established between the vehicles, according to established protocols, in a manner that is designated for establishing the data network. The method further comprises designating a first vehicle of the plurality of vehicles as a network lead vehicle of the data network. "Network lead vehicle" means a vehicle in the consist that is primarily responsible for controlling operations of the data network in the consist. The method further comprises designating a second vehicle of the plurality of vehicles as a network trail vehicle of the data network. "Network trail vehicle" means a vehicle in the consist that is subordinate to the network lead vehicle in regards to one or more aspects of data network operation. The method further comprises communicating network data between the plurality of vehicles (e.g., to/from one vehicle to/from another vehicle or vehicles) based at least in part on the first vehicle designated as the network lead vehicle and the second vehicle designated as the network trail vehicle. Thus, for example, the network lead vehicle may be responsible for setting up and maintaining network routing tables for services and/or communications in the network, and the network trail vehicle may communicate according to the network routing tables set up and maintained by the network lead vehicle.

In an embodiment where the vehicles are rail vehicles in a rail vehicle consist, the method comprises linking the plurality of rail vehicles to establish a data network. The method further comprises designating a first rail vehicle of the plurality of rail vehicles as a network lead rail vehicle of the data network. As with network lead vehicles more generally, "network lead rail vehicle" (e.g., network lead locomotive) refers to a locomotive or other rail vehicle in the consist that is primarily responsible for controlling operations of the data network in the consist. The method further comprises designating a second rail vehicle of the plurality of rail vehicles as a network trail rail vehicle of the data network. "Network trail rail vehicle" (e.g., network trail locomotive) means a locomotive or other rail vehicle in the consist that is subordinate to the network lead rail vehicle in regards to one or more aspects of data network operation. The method further comprises communicating network data between the plurality of rail vehicles based at least in part on the first vehicle designated as the network lead vehicle and the second vehicle designated as the network trail vehicle. As indicated, the rail vehicles may be locomotives.

Another embodiment relates to a communication system (e.g., for a vehicle consist) comprising a first controller unit configured for operative coupling in a first rail vehicle. The first controller unit is configured, when the first rail vehicle is linked with one or more second rail vehicles in a data network of a consist, to designate one of the first rail vehicle or one of the one or more second rail vehicles as a network lead rail vehicle of the data network and to designate all other rail vehicles in the consist as network trail rail vehicles of the data network. The first controller unit is further configured to control communications of network data between the first rail vehicle and the one or more second rail vehicles based at least in part on the network lead rail vehicle and network trail rail vehicle designations. Again, the rail vehicles may be locomotives.

In another embodiment of a communication system, the communication system comprises a first controller unit configured for operative coupling in a first rail vehicle. The first controller unit is configured, when the first rail vehicle is linked with one or more second rail vehicles in a data network of a consist, to enter a first designated mode of operation responsive to communications between the first rail vehicle and the one or more second rail vehicles for selecting the first rail vehicle to operate in the first designated mode of operation and the one or more second rail vehicles to operate in a different, second designated mode of operation. The first controller unit is further configured, when in the first designated mode of operation, to at least one of: coordinate data traffic in the data network of the consist; and/or configure and manage services available to plural entities of the data network of the consist (entity referring to a device or other system or subsystem that utilizes and/or communicates network data). The rail vehicles may be locomotives.

Other embodiments of the present invention relate to a system and method for managing network services and devices among a plurality of locomotives or other vehicles in a consist. For example, in one embodiment of a communication method, the method comprises, in a vehicle consist comprising a plurality of vehicles connected in a data network, storing in a first vehicle of the consist a list of available services that are available across one or more of the vehicles of the consist connected in the data network. For example, the services may comprise functions that can be performed by available devices of the network, which process, communicate, or otherwise use network data. ("Available" service or device refers to a service or device that is operably connected for potentially using network data that is communicated in the data network, not necessarily that the service or device is currently operational for doing so.) The method further comprises, at the first vehicle, communicating first information of the list of available services to other vehicles in the consist.

In another embodiment of a communication method in a vehicle consist comprising a plurality of vehicles linked together in a data network, the method comprises monitoring plural available devices of the vehicles in the consist to determine respective operational statuses of the plural available devices. The method further comprises maintaining information of the operational statuses of the plural available devices in a database, and communicating the information of the operational statuses to the plural vehicles in the consist.

In another embodiment of a communication method in a vehicle consist comprising a plurality of vehicles linked together in a data network, the method comprises receiving information of respective operational statuses of plural available devices and/or services of the vehicles in the consist. The method further comprises maintaining information of the operational statuses of the plural available devices and/or services in a database, communicating the information of the operational statuses to the plural vehicles in the consist, and routing data in the data network based at least in part on the information of the operational statuses.

Another embodiment relates to a communication system. The system comprises a monitoring device configured for deployment on board a vehicle consist having a plurality of vehicles linked together in a data network. The monitoring device is further configured to communicate with plural available devices of the vehicles for determining respective operational statuses of the available devices. The monitoring device is further configured to store information of the operational statuses of the available devices. The system further comprises a signal transmitting device configured for deployment on board the vehicle consist, and further configured to communicate the information of the operational statuses of the available devices to the plural vehicles and/or to route network data based on the information of the operational statuses of the available devices.

Another embodiment relates to a system for managing network services among locomotives or other vehicles in a consist. The system comprises a first available device positioned in a first locomotive (or other first vehicle) in the consist, and a second available device positioned in a second locomotive (or other second vehicle) in the consist. The first and second available devices are at least substantially equivalent (also referred to as a substantially similar), meaning that in regards to a designated function, the devices are both capable of performing the designated function at the same performance level, or of performing the designated function not at the same performance level but within a designated performance tolerance range (e.g., 5-10%), or of performing a different function that nevertheless meets one or more operational or performance criteria of the designated function. The system further comprises a monitoring device configured for deployment on one of the locomotives (or other vehicles) in the consist and to communicate with the first and second available devices. The monitoring device is further configured to determine an operational status of the first and second available devices. The system further comprises a signal transmitting device configured to communicate with the first and second available devices and configured to route traffic to the first available device or the second available device when the monitoring unit determines that the other of the first available device or the second available device has entered into a failure state (meaning incapable of performing a designated function at all, or incapable of performing the designated function above designated performance level threshold(s)).

Other embodiments of the present invention relate to a system and method for managing a high-availability network for a locomotive consist or other vehicle consist. (High availability refers to having a greater degree of availability, by way of communicating over plural networks and/or channels, than communicating over fewer networks and/or channels.) For example, in one embodiment of a method for communications in a vehicle consist, the method comprises monitoring respective operational statuses of a plurality of network channels across a plurality of vehicles in the consist, and routing messages through one or more of the network channels in dependence upon the monitored operational statuses of the network channels.

In another embodiment of a method for communications in a vehicle consist, the method comprises monitoring respective operational statuses of a first network and a second network of the vehicle consist. The first and second networks are at least logically distinct (meaning physically different and separate, or otherwise separated by using designated communication logic, such that data can be transmitted independently through the networks). The method further comprises routing messages through the first network and the second network based at least in part on the monitored operational statuses of the first network and the second network.

In another embodiment of a method for communications in a vehicle consist, the method comprises, at a first vehicle of the vehicle consist, transmitting and/or receiving first signals of a first network established between the first vehicle and one or more second vehicles of the vehicle consist. The method further comprises, at the first vehicle, transmitting and/or receiving second signals of a second network established between the first vehicle and one or more second vehicles of the vehicle consist. The first and second networks are at least logically distinct.

Another embodiment relates to a system for communications in a vehicle consist. The system comprises a routing unit configured for communication across a first plurality of communication channels associated with a first vehicle of the vehicle consist and a second plurality of communication channels associated with a second vehicle of the vehicle consist. The routing unit is configured for deployment on board one of the first vehicle or the second vehicle. The routing unit is further configured for routing a message through at least one of the first plurality of communication channels and at least one of the second plurality of channels in dependence upon respective operational statuses of the first and second pluralities of communication channels.

Another embodiment relates to a system for managing a high-availability network for a locomotive consist. The system comprises a first plurality of communication channels associated with a first locomotive and a second plurality of communication channels associated with a second locomotive. A routing unit in communication with the first and second plurality of communication channels is configured for routing a message through at least one of the first plurality of communication channels of the first locomotive and at least one of the second plurality of channels of the second locomotive in dependence upon an operational status of the first and second plurality of communication channels.

Yet other embodiments of the present invention relate to a system and method for resolving a conflict between IP addresses of locomotives or other vehicles in a consist. In one embodiment of the method, it is determined that a first locomotive or other first vehicle in the consist has an IP address that is the same as an IP address of a second locomotive or other vehicle in the consist. An unused IP address is then identified and assigned to the first vehicle or to the second vehicle.

In one embodiment, a method for communications in a vehicle consist (e.g., a locomotive or other rail vehicle consist) comprises determining that a first vehicle in the vehicle consist (e.g., a first locomotive or other first rail vehicle) has a network address (e.g., a first IP address) that is the same as a network address (e.g., a second IP address) of a second vehicle in the vehicle consist (e.g., a second locomotive or other second rail vehicle). The method further comprises identifying an unused network address, and communicating signals for assignment of the unused network address to one of the first vehicle or the second vehicle. By referring to a vehicle having a network address, this includes: the vehicle itself having the network address associated with the vehicle; and/or that a component of the vehicle capable of network communications has the network address assigned, determined, or otherwise associated with it.

In another embodiment, a method for communications in a vehicle consist (e.g., a locomotive or other rail vehicle consist) comprises determining (e.g., calculating, identifying, allocating, or the like) a first network address (e.g., a first IP address) for a first vehicle in the vehicle consist (e.g., a first locomotive or other first rail vehicle) and a second network address (e.g., a second IP address) for a second vehicle in the vehicle consist (e.g., a second locomotive or other second rail vehicle). The first vehicle and the second vehicle are linked in a data network. The method further comprises identifying a conflict between the first network address and the second network address. For example, the conflict might be that the first network address is the same as the second network address. Responsive to identifying the conflict, the method further comprises selecting the first vehicle for network address re-assignment (i.e., one of the first vehicle or the second vehicle is selected, and in this example it is the first vehicle that is selected). The method further comprises determining a third network address that is not in conflict with the second network address of the second vehicle, and assigning the third network address to the first vehicle in place of the first network address. Data is communicated in the data network based at least in part on the second network address and the third network address.

In another embodiment, a method for communications in a vehicle consist (e.g., a locomotive or other rail vehicle consist) comprises determining that a first vehicle in the vehicle consist (e.g., a first locomotive or other first rail vehicle) has a first network address that is the same as a second network address of a second vehicle in the vehicle consist (e.g., a second locomotive or other second rail vehicle). The first vehicle and the second vehicle are linked in a network. The method further comprises identifying an unused network address of the network, and communicating signals for assignment of the unused network address to one of the first vehicle or the second vehicle.

Another embodiment relates to a system for communications in a vehicle consist (e.g., a locomotive or other rail vehicle consist). The system comprises a conflict determination module configured for communication with a first vehicle (e.g., a first locomotive or other first rail vehicle) having a first network address (e.g., a first IP address) and a second vehicle (e.g., a second locomotive or other second rail vehicle) having a second network address (e.g., a second IP address). The conflict determination module is further configured to determine if the first network address is the same as the second network address. The system further comprises a control module configured for deployment on at least one of the first vehicle or the second vehicle and further configured to identify an unused network address. The control module is configured to assign the unused network address to one of the first vehicle or the second vehicle if the conflict determination module determines that the first network address is the same as the second network address.

Any of the aforementioned embodiments are also applicable for communicating data in vehicle consists generally. "Vehicle consist" refers to a group of vehicles that are mechanically coupled or linked together to travel along a route.

In any of the embodiments set forth herein, data transmitted over the MU cable bus or other communication means may be used for locomotive or other vehicle control, such as controlling the locomotive or other vehicle for movement along a route. While this Ethernet over MU communications system may be utilized in connection with the embodiments of the invention discussed below, the embodiments are not limited to use with an Ethernet over MU system. In particular, the embodiments of the present invention discussed below may also be employed and utilized in connection with a wireless communications system such as one using radio equipment to facilitate communication between locomotives in the consist. In addition, the embodiments described below may also be used with a communication system that utilizes dedicated network cables between the linked locomotives in a consist.

BRIEF DESCRIPTION OF THE DRAWINGS

The present invention will be better understood from reading the following description of non-limiting embodiments, with reference to the attached drawings, wherein below.

DETAILED DESCRIPTION OF THE INVENTION

Figure 1:
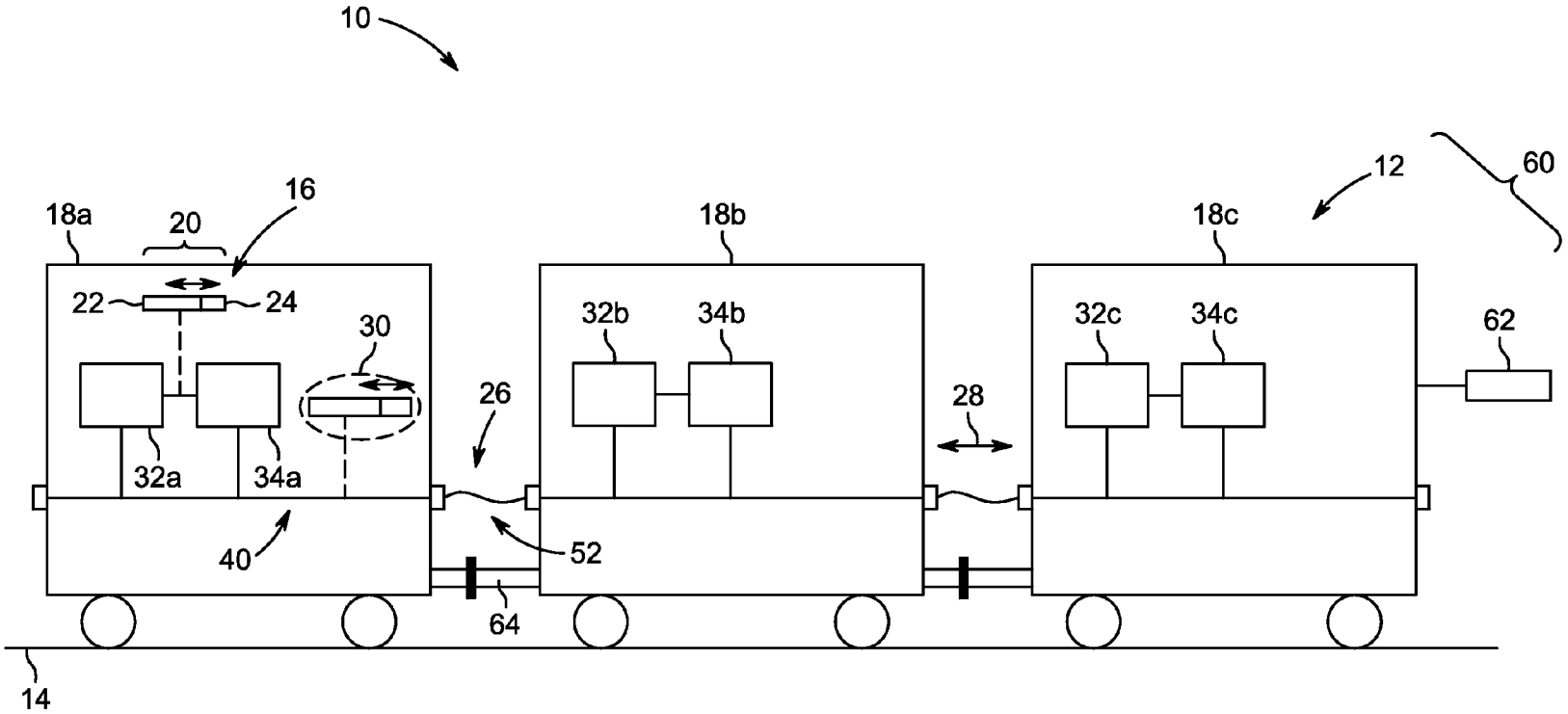
FIG. 1 is a schematic diagram of a communication system for communicating data in a locomotive consist, according to an embodiment of the present invention.

Embodiments of the invention relate to communication systems and methods for a vehicle consist comprising a plurality of vehicles. For example, according to one aspect, subsequent to the vehicles being linked in a data network, a first vehicle of the plurality of vehicles is designated as a network lead vehicle of the data network. As noted above, "network lead vehicle" means a vehicle in the consist that is primarily responsible for controlling operations of the data network in the consist, for example, "network lead rail vehicle" (e.g., network lead locomotive) refers to a locomotive or other rail vehicle in the consist that is primarily responsible for controlling operations of the data network in the consist. Further, a second vehicle of the plurality of vehicles is designated as a network trail vehicle of the data network. As also noted above, "network trail vehicle" means a vehicle in the consist that is subordinate to the network lead vehicle in regards to one or more aspects of data network operation, for example "network trail rail vehicle" (e.g., network trail locomotive) refers to a locomotive or other rail vehicle in the consist that is subordinate to the network lead rail vehicle in regards to one or more aspects of data network operation. Network data is communicated between the plurality of vehicles based at least in part on the first vehicle designated as the network lead vehicle and the second vehicle designated as the network trail vehicle. Thus, in the case of locomotives in a rail vehicle consist (for example), embodiments of the invention establish an operative communication network across the consist through which the locomotives may effectively communicate with one another, including managing services and devices deployed on locomotives across the consist.

Reference will be made below in detail to exemplary embodiments of the invention, examples of which are illustrated in the accompanying drawings. Wherever possible, the same reference numerals used throughout the drawings refer to the same or like parts. Although exemplary embodiments of the present invention are described with respect to trains, locomotives, and other rail vehicles, embodiments of the invention are also applicable for use with vehicles generally, such as off-highway vehicles, agricultural vehicles, and/or transportation vehicles, each of which may be included in a vehicle consist. As noted above, a vehicle consist (e.g., locomotive consist) is a group of vehicles (e.g., locomotives) that are mechanically coupled or linked together to travel along a route, with each vehicle in the consist being adjacent to one or more other vehicles in the consist.

With reference to FIG. 1, an exemplary communication system 10 for communicating data in a locomotive consist 12 is shown. The consist 12 may be configured to travel along a railway 14, for example. In the system 10, network data 16 is transmitted from one locomotive 18*a* in the consist 12 (e.g., a lead locomotive 18*a*) to one or more other locomotives 18*b*, 18*c* in the consist (e.g., a trail locomotive 18*b* and/or 18*c*). Each locomotive 18*a*-18*c* is adjacent to and mechanically coupled with another locomotive in the consist 12 such that all locomotives in the consist are connected (directly or indirectly by way of one or more non-locomotive rail vehicles). "Network data" 16 refers to data that is packaged in packet form, meaning a data packet that comprises a set of associated data bits 20, e.g., Ethernet-formatted data packets. (Each data packet may include a data field 22 and a network address or other address 24 uniquely or otherwise associated with a computer unit or other electronic component in the consist 12.) The network data 16 is transmitted over a locomotive multiple unit (MU) cable bus 26. The MU cable bus 26 is an existing electrical bus interconnecting the lead locomotive 18*a* and the trail locomotives 18*b*, 18*c* in the consist. The MU cable bus 26 is used in the locomotive consist 12 for transferring non-network control information 28 between locomotives in the consist. "Non-network" control information 28 refers to data or other information, used in the locomotive consist for control purposes, which is not packet data. In another aspect, non-network control information 28 is not packet data, and does not include recipient network addresses.

Figure 2:
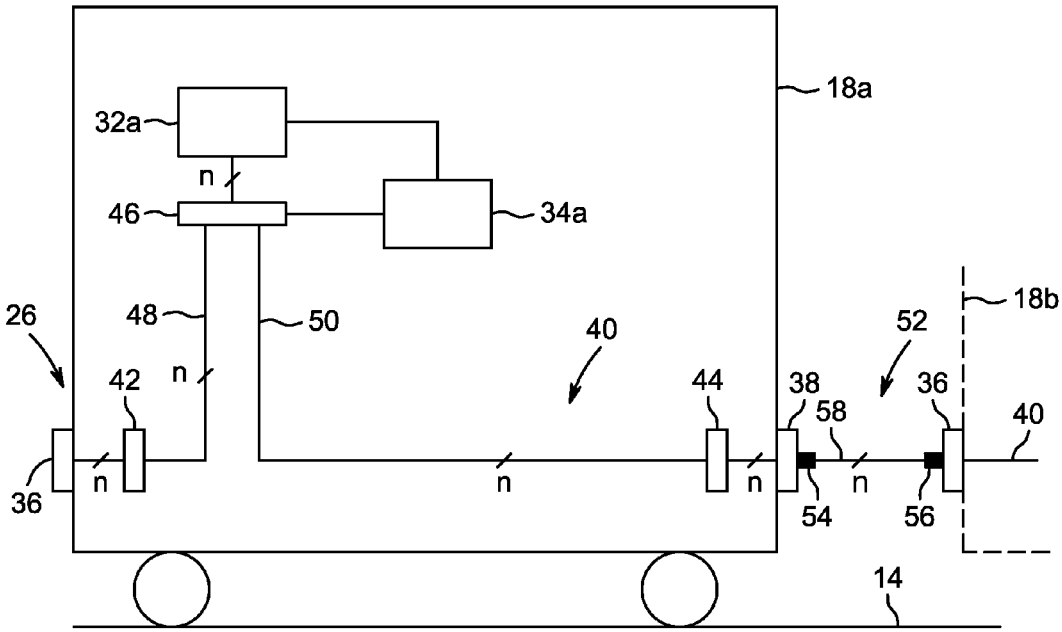
FIG. 2 is a schematic diagram of an MU cable bus in a locomotive, shown in the context of the communication system of FIG. 1.

One example of an MU cable bus 26 is shown in more detail in FIG. 2. Other configurations are possible, depending on the type of locomotive involved. The MU cable bus 26 is an existing electrical bus interconnecting the lead locomotive 18*a* and the trail locomotives 18*b*, 18*c* in the consist. In each locomotive, e.g., the lead locomotive 18*a* as shown in FIG. 2, the MU cable bus 26 comprises a front MU port 36, a rear MU port 38, and an internal MU electrical system 40 that connects the front port 36 and the rear port 38 to one or more operational/electronic components 32*a* of the locomotive 18*a*. In the illustrated example, the internal MU electrical system 40 comprises a front terminal board 42 electrically connected to the front MU port 36, a rear terminal board 44 electrically connected to the rear MU port 38, a central terminal board 46, and first and second electrical conduit portions 48, 50 electrically connecting the central terminal board 46 to the front terminal board 42 and the rear terminal board 44, respectively. The one or more electronic components 32*a* of the locomotive 18*a* may be electrically connected to the central terminal board 46, and thereby to the MU cable bus 26 generally. Although the front MU port 36 and rear MU port 38 may be located generally at the front and rear of the locomotive 18*a*, this is not always the case, and designations such as "front," "rear," "central," etc. are not meant to be limiting but are instead provided for identification purposes.

Figure 3:
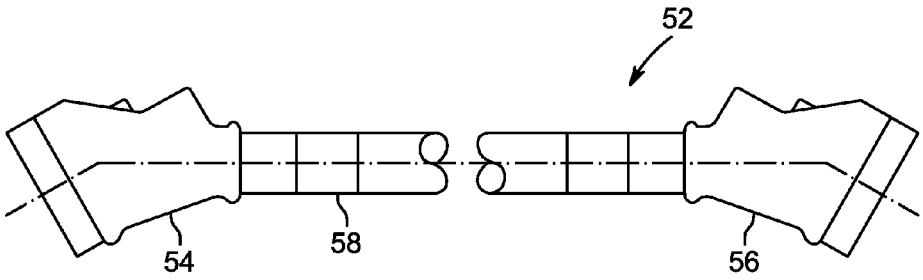
FIG. 3 is a schematic diagram of an MU cable jumper.

As shown in FIGS. 2 and 3, the MU cable bus 26 further comprises an MU cable jumper 52. The jumper 52 comprises first and second plug ends 54, 56 and a flexible cable portion 58 electrically and mechanically connecting the plug ends together. The plug ends 54, 56 fit into the MU ports 36, 38. The MU cable jumper 52 may be electrically symmetrical, meaning either plug end can be attached to either port. The MU cable jumper 52 is used to electrically interconnect the internal MU electrical systems 40 of adjacent locomotives, e.g., locomotive 18*a* and locomotive 18*b*. As such, for each adjacent pair of locomotives 18*a*, 18*b*, one plug end 54 of an MU cable jumper 52 is attached to the rear MU port 28 of the front locomotive 18*a*, and the other plug end 56 of the MU cable jumper 52 is attached to the front MU port 36 of the rear locomotive 18*b*. The flexible cable portion 58 of the MU cable jumper 52 extends between the two plug ends, providing a flexible but secure electrical connection between the two locomotives 18*a*, 18*b*.

Depending on the particular type and configuration of locomotives, the electrical conduit portions 48, 50 and MU cable jumpers 52 may be configured in different manners, in terms of the number "n" ("n" is a real whole number equal to or greater than 1) and type of discreet electrical pathways included in the conduit or jumper. In one example, each conduit portion 48, 50 and the jumper cable portion 58 comprises a plurality of discreet electrical wires, such as 12-14 gauge copper wires. In another example, the cable portion 58 (of the MU cable jumper 52) comprises a plurality of discreet electrical wires, while the conduit portions 48, 50 each include one or more discreet electrical wires and/or non-wire electrical pathways, such as conductive structural components of the locomotive, pathways through or including electrical or electronic components, circuit board traces, or the like. Although certain elements in FIG. 2 are shown as including "n" discreet electrical pathways, it should be appreciated that the number of discreet pathways in each element may be different, i.e., "n" may be the same or different for each element.

As noted, the plug ends 54, 56 of the MU cable jumper 52 fit into the MU ports 36, 38. For this purpose, the plug ends and MU ports are complementary in shape to one another, both for mechanical and electrical attachment. The plug end 54, 56 may include a plurality of electrical pins, each of which fits into a corresponding electrical socket in an MU port. The number of pins and sockets may depend on the number of discreet electrical pathways extant in the internal electrical conduits 40, MU cable jumpers 52, etc. In one example, each plug end 54, 56 is a twenty seven-pin plug.

The central terminal board 46, front terminal board 42, and rear terminal board 44 each comprise an insulating base (attached to the locomotive) on which terminals for wires or cables have been mounted. This provides flexibility in terms of connecting different electronic components to the MU cable bus.

The term "MU cable bus" refers to the entire MU cable bus or any portion(s) thereof, e.g., terminal boards, ports, jumper cable, conduit portions, and the like. As should be appreciated, when two locomotives are connected via an MU cable jumper 52, both the MU cable jumper 52 and the internal MU electrical systems 40 of the two locomotives together form the MU cable bus. As subsequent locomotives are attached using additional MU cable jumpers 52, those cable jumpers and the internal MU electrical systems 40 of the subsequent locomotives also become part of the MU cable bus.

As indicated in FIG. 1, the locomotive consist 12 may be part of a train 60 that includes the locomotive consist 12, a plurality of railcars 62, and possibly additional locomotives or locomotive consists (not shown). Each locomotive 18*a*-18*c* in the consist 12 is mechanically coupled to at least one other, adjacent locomotive in the consist 12, through a coupler 64. The railcars 62 are similarly mechanically coupled together and to the locomotive consist to form a series of linked vehicles. The non-network control information may be used for locomotive control purposes or for other control purposes in the train 60.

The communication system 10 may comprise respective router transceiver units 34*a*, 34*b*, 34*c* positioned in the lead locomotive 18*a* and each of the trail locomotives 18*b*, 18*c* in the locomotive consist 12. The router transceiver units 34*a*, 34*b*, 34*c* are each electrically coupled to the MU cable bus 26. The router transceiver units 34*a*, 34*b*, 34*c* are configured to transmit and/or receive network data 16 over the MU cable bus 26.

The communications system 10 shown in FIG. 1 is intended to be illustrative of a communications system that may be utilized in connection with the embodiments of the present invention disclosed below. While this Ethernet over MU communications system (that utilizes an existing locomotive multiple unit (MU) cable bus that interconnects the lead locomotive and the trail locomotives) may be utilized in connection with the embodiments of the invention discussed below, the embodiments are not limited to use with an Ethernet over MU system. In particular, the embodiments of the present invention discussed below may also be employed and utilized in connection with a wireless communications system such as one using radio equipment to facilitate communication between locomotives in the consist. In addition, the embodiments described below may also be used with a communication system that utilizes dedicated network cables between the linked locomotives in a consist.

Figure 4:
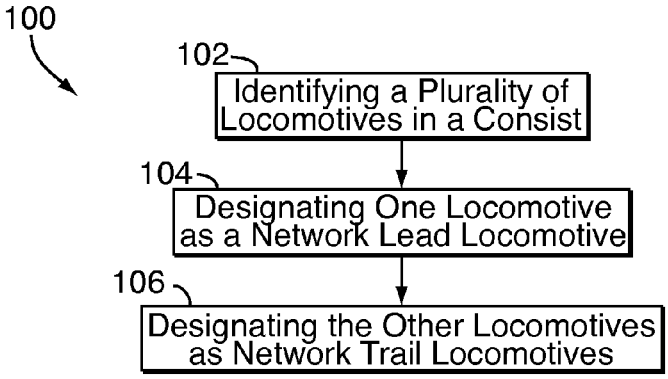
FIG. 4 is a flowchart illustrating an exemplary method for establishing a network across a plurality of locomotives in a consist, according to an embodiment of the present invention.

Embodiments of the present invention relate to a system and method for determining the network lead vehicle among a plurality of vehicles in a consist. In an embodiment, the vehicles may be locomotives, although the system and method may also be used in connection with other rail vehicles and non-rail vehicles. FIG. 4 illustrates an exemplary method 100 for establishing a network across a plurality of locomotives in a consist, according to one embodiment of the present invention.

In embodiments, a network lead locomotive is designated to configure all the services for a respective data network of the locomotives in the consist, and may be responsible for signal/traffic coordination for various devices on board each locomotive. In an embodiment, when a locomotive is by itself such that there are no other locomotives in communication with it in a train or other rail vehicle consist, the locomotive is designated as the network lead locomotive. As the network lead locomotive, the locomotive establishes a set of services and operations it is capable of performing and manages this "network" of a single locomotive. The set of services established and managed by the locomotive may include conventional available devices, for example, 220 MHz radio gear and components for communication purposes and GPS systems and components, as well as horns, lights and other indicators and systems utilized during operation of the consist.

In another embodiment, the consist may include more than one locomotive that is capable of functioning as the network lead locomotive. As shown in FIG. 4, the method first includes the step 102 of identifying a plurality of locomotives in the consist. In such an instance, the locomotives may be mechanically coupled and in communication with one another, such as being linked through a multiple unit cable. If there is more than one "lead" locomotive, however, such as if a single network lead locomotive has not been designated, then a network conflict may arise which could cause network traffic and packets to be missed because of a trail locomotive attempting to find a lead or a lead trying to find a trail.

Accordingly, in consists containing more than one locomotive that is capable as functioning as a network lead locomotive, it becomes necessary to then determine which of the locomotives in the consist will be designated, and serve as, the network lead locomotive of the data network for the consist, at step 104. In an embodiment, the network lead locomotive may be determined by one or more locomotive parameters or characteristics. In one embodiment, the parameter may be one or more positions of one or more of the locomotives in the consist. For example, the first locomotive in the consist may be designated the network lead locomotive of the data network based on its position at the head of the consist. After designating a network lead locomotive, the remaining locomotives or vehicles in the consist are designated network trail locomotives or vehicles, at step 106. In an embodiment, the steps of designating the network lead and trail locomotives may be carried out automatically subsequent to the locomotives being linked to establish the data network. In an embodiment, designating a locomotive as a network lead locomotive includes configuring the locomotive for operations as the network lead locomotive and communicating status information indicative of its designation as network lead to the other locomotives in the consist, and configuring the other locomotives in the consist as network trail locomotives.

In another embodiment, the lead network locomotive may be designated based on a temporal sequence of addition to the consist. In particular, if a data network already exists and has a designated network lead locomotive, other locomotives that are subsequently added to the consist may automatically be designated as trail locomotives.

In yet another embodiment, the network lead locomotive may be designated based upon movement of the locomotives in the consist, such as a GPS or otherwise determined direction of movement of the consist. In particular, in an embodiment a locomotive may be designated as the network lead locomotive based on the locomotive being a leading locomotive of the consist in a designated direction of travel of the consist.

In other embodiments, the network lead locomotive may be designated after the consist begins moving based upon an algorithm. In this embodiment, GPS information (e.g., direction and speed), wheel speed information, locomotive engineer handle direction information and/or switch settings for lead/trail or headlight configuration may be utilized by the locomotives to determine and then designate lead and trail locomotives in the consist. In an embodiment, a wheel speed sensor may be utilized to detect and relay wheel speed to at least one available device, such as a controller, on board at least one of the locomotives. The sensor may also be configured to sense a direction of the locomotive. With respect to engineer handle direction, i.e., handle position, in an embodiment, if the handle is in the forward position and the locomotive is travelling above a threshold speed, then the position of the locomotives from a GPS unit can determine the front, middle and rear of the consist. Given this information, an algorithm can then determine and designate a lead and trail locomotives.

In another embodiment, the locomotives within the consist, once linked to establish a data network, may communicate setup data to one another. One locomotive in the consist may then be designated as the network lead locomotive in the data network and other locomotives designated as network trail locomotives based on the setup data. Communication of the setup data may be carried out automatically subsequent to the locomotives being linked. In the event that another locomotive is subsequently added to the consist, setup data may be communicated between the added locomotive and a first locomotive in the consist (which may have been previously designated as network lead). Based upon the setup data, the added locomotive may be designated as an additional network trail locomotive. Alternatively, the added locomotive may be designated as the network lead locomotive in conjunction with designating the first locomotive as a now network trail locomotive of the data network.

Once the locomotives have been linked to establish a data network, and lead and trail locomotives of the data network have been designated, network data may be communicated between the locomotives based at least in part on the one locomotive designated as the network lead locomotive and one or more other locomotives designated as network trail locomotives, as discussed hereinafter. As alluded to above, designating a single locomotive to serve as the network lead locomotive is important from a controls perspective. In an embodiment, the designated network lead locomotive may configure services available to entities in the data network and coordinate data traffic in the data network. In particular, the network lead locomotive may store, create and update the master routing tables relating to services of the respective locomotives in the consist and is also capable of transitioning services from one locomotive to another, such as from the network lead locomotive to one of the trail locomotives. In addition, the network trail locomotives may request overall network information from the network lead locomotive.

Moreover, by knowing the network lead locomotive, network services can be managed across the consist and traffic may be sent to lead or trail vehicles in the consist. For example, in an embodiment, a device on the network lead locomotive may want to utilize a radio on a trail locomotive because the radio on the lead locomotive is broken or otherwise non-functional. By recognizing that the radio of the lead locomotive is non-functional, and that a trail locomotive has a functioning radio, the network lead locomotive can route radio traffic to the functioning radio on board the trail locomotive to maintain desired functionality. In addition, the lead locomotive may update the master routing tables such that all radio traffic is routed to the functioning radio, as opposed to the currently non-functioning radio on board the lead locomotive.

In an embodiment, the consist data network is established and the network lead locomotive is automatically designated through the communication of the locomotives, as discussed above. In particular, upon being placed in communication with one another, such as through a MU cable bus, dedicated network cables, through wireless communications, etc., the locomotives determine, according to a predetermined set of commands and in view of one or more locomotive parameters, as discussed above, which locomotive will be designated the network lead locomotive and which will then be designated trail locomotives.

Figure 5:
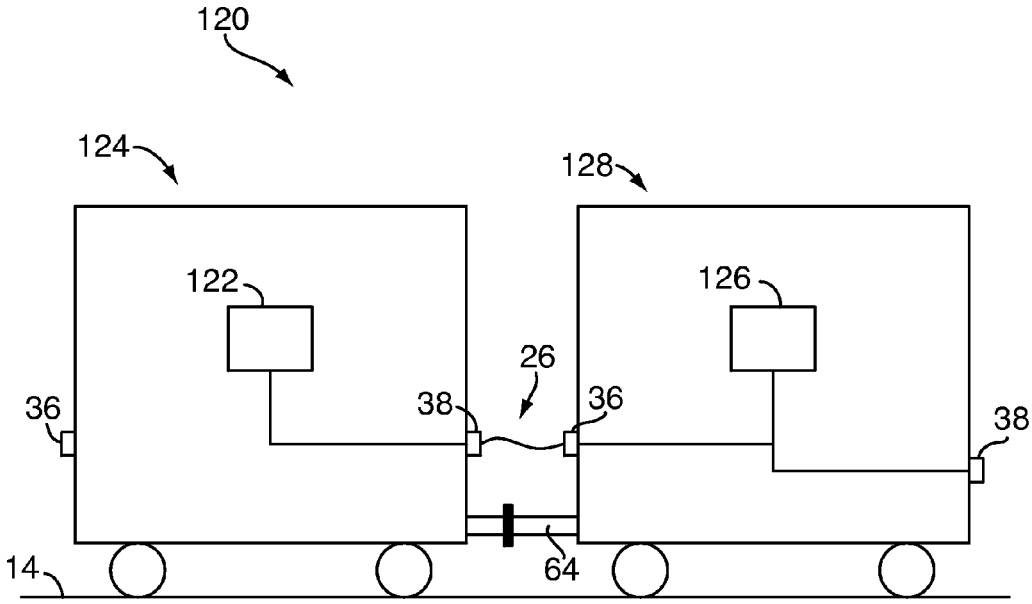
FIG. 5 is a schematic diagram of a system for establishing a network across a plurality of locomotives in a consist, according to an embodiment of the present invention.

FIG. 5 is a schematic diagram of a system 120 for establishing a network across a plurality of locomotives in a consist, according to an embodiment of the present invention. As shown therein, the system includes an electronic component such as a first controller unit 122 positioned in a first locomotive 124 in the consist, and a second electronic component such as a second controller 126 unit positioned in a second locomotive 128 in the consist and in communication with the first controller unit 122 in the first locomotive 124. The first locomotive 124 is adjacent to and mechanically coupled with the second locomotive 128 though a coupler 64, as discussed above. The first controller 122 and second controller 126 are configured to designate the network lead locomotive and network trail locomotive(s) according to at least one parameter of the locomotives in the consist, as discussed above.

In connection with this, the first controller 122 is configured to designate one of the locomotives in the data network of the consist as a network lead locomotive of the data network and to designate all other locomotives in the consist as network trail locomotives of the data network. Moreover, the first controller unit is further configured to control communications of network data between the lead locomotive and trail locomotives based at least in part on the network lead locomotive and network trail locomotive designations. In connection with designating network lead and trail locomotives based on at least one parameter of the locomotives, the at least one parameter may be one or more of a position of a first locomotive relative to one or more other locomotives in the consist, a sequence of locomotives added to the consist, or an identification of which locomotive in the consist is a leading locomotive of the consist in a designated direction of travel.

In another embodiment, the first controller unit 122 is configured to automatically control communication setup data between the first locomotive 124 and one or more second locomotives 128 subsequent to establishment of the data network in the consist. In addition, the first controller unit 122 may designate the network lead locomotive and trail locomotive(s) based at least in part on the setup data. In an embodiment, information of the parameter (e.g., sequence of the locomotives added to the consist, or the like) may be included in the setup data.

Once network lead and trail locomotives are designated (regardless of the exact manner in which such designations are effected) the first controller 122 is adapted to configure services available to entities in the data network and to coordinate data traffic in the data network.

Figure 6:
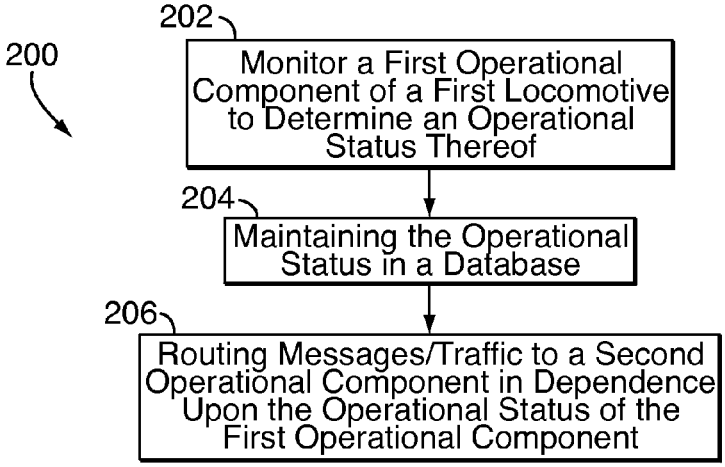
FIG. 6 is a flowchart illustrating an exemplary method for managing network services among a plurality of networked locomotives in a consist, according to an embodiment of the present invention.
Figure 7:
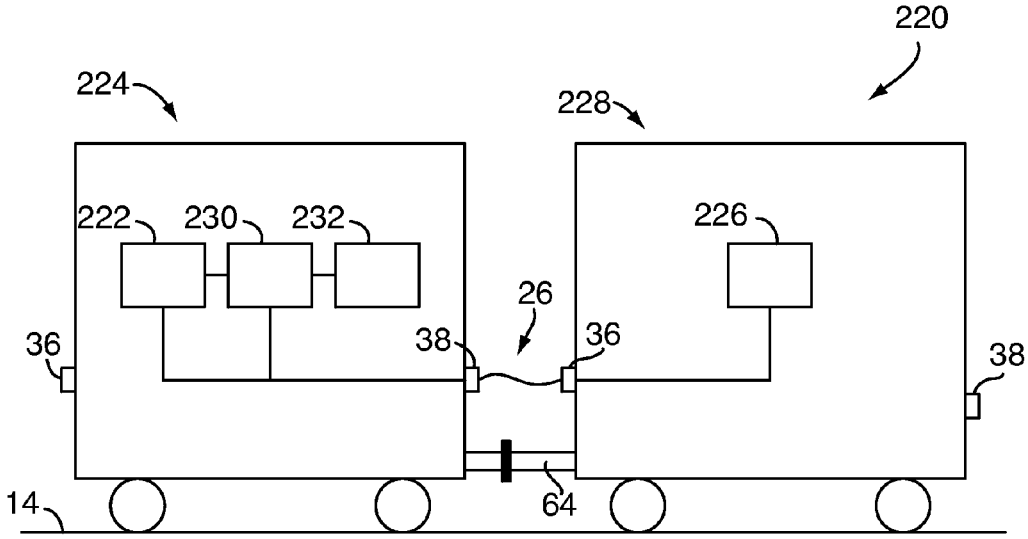
FIG. 7 is a schematic diagram of a system for managing network services among locomotives in a consist, according to an embodiment of the present invention.

As shown in FIGS. 6 and 7, embodiments of the present invention also relate to a system and method for managing network services and devices among a plurality of vehicles or locomotives in a consist. FIG. 6 illustrates an exemplary method 200 for managing network services among a plurality of networked locomotives in a consist, according to an embodiment of the present invention.

As discussed above, a locomotive consist includes a plurality of locomotives that are mechanically coupled or linked together to travel along a route and which are in communication with one another such that they function together as a single unit on a network. As further discussed above, the locomotives may be in communication with one another wirelessly, through dedicated network cables, through an MU cable bus interconnecting adjacent locomotives in the consist, etc. In this manner, the on-board available devices of the locomotives may be linked together as a computer data network such that the devices of the vehicles can communicate with one another. (As noted elsewhere herein, device refers to an electronic equipment, and service refers to a function performable by the electronic equipment. "Available" service or device refers to a service or device that is operably connected for potentially using network data communicated in the data network, not necessarily that the service or device is currently operational for doing so.)

In an embodiment, a vehicle consist includes a plurality of locomotives (or other vehicles), each having one or more available devices configured for deployment thereon. The plurality of locomotives includes a lead locomotive (or other lead vehicle), as discussed above, and at least one trail locomotive (or other trail vehicle). Upon joining the locomotives (or other vehicles) together in the consist, in an embodiment, a database of services and devices available across all of the networked locomotives (or other vehicles) in the consist is constructed, to avoid conflicts in routing data in the network. In an embodiment, the database is a part of at least one available device (e.g., a monitoring device and/or signal transmitting device) of the lead locomotive (or other lead vehicle) and is accessible by at least one of the trail locomotives (or other trail vehicles). The database may also be referred to as a master service list or routing list. Additional devices or services may be registered/listed in the database as they are joined to the network, including the services and devices/available devices of the lead locomotive.

In an embodiment, the operability of available devices/devices and services may be automatically determined based on port scan and/or network traffic to/from that component/device, at step 202. In particular, one of the available devices on the lead locomotive (or other lead vehicle), such as a monitoring device (e.g., controller) and associated database, may orchestrate a periodic scan of available devices (and new devices) to maintain the master service and routing list, at step 204. Scanning may include determining available services. Remote router transceiver units, for example, may be utilized to coordinate available services with the monitoring device. In this respect, trail locomotives (or other trail vehicles) do not need to know anything about the broad consist network, IP addresses of other locomotives (or other vehicles) in the consist, etc., but instead simply maintain a list of available services and/or devices thereon which can be communicated to the lead locomotive (or other lead vehicle of the consist) for compilation in the master device/service list.

Once the routing list/master service list is constructed, various threads of software, known as agents, can provide the information contained in the list to the devices across the consist, assist the devices in the routing of messages, and/or provide complete failover control of message routing to trail locomotives (or other trail vehicles), as discussed hereinafter. As noted above, the lead locomotive (or another designated vehicle) in the consist gathers and maintains the list of available services/devices and is capable of delegating services to trail locomotives (or other delegate vehicles) in the consist.

In an embodiment, the consist also includes a failover mechanism. In particular, an available device on the lead locomotive (or other designated vehicle of the consist), such as the monitoring device (e.g., controller), may also determine, in addition to the services and devices available across all of the locomotives (or other vehicles of the consist), which devices can or cannot be failed over to working devices. In an embodiment, a list of the devices that can/cannot be failed over can be constructed and maintained by the lead locomotive (or other designated vehicle of the consist) by any of device type, IP address range, or configuration file setup.

In operation, if a particular device is designated as a device that can be failed over, then message traffic may be routed according to a routing algorithm (executed by the monitoring device and/or signal transmitting device) to a substantially equivalent device on another locomotive (or other vehicle) for processing, such as at step 206. In an embodiment, the routing algorithm may use a method, such as SNMP, to periodically scan to determine if a device is still operational. If it is, then data/messages/traffic will continue to be delivered to the device and the device will be listed with the master service list that it is operational as a candidate that can receive messages/data/traffic from another locomotive (or other vehicle). As will be readily appreciated, such an "operational" status also means that the device is also available to receive another device's failover messages. For example, if a 220 MHz radio fails on the lead locomotive, the traffic may be automatically routed to a 220 MHz radio on a trailing locomotive to maintain functionality for the consist as a whole.

In connection with the system described above, at any point in time, a device on a vehicle of the consist can request data/messages/traffic to be routed to an off-board vehicle (i.e., to another vehicle in the consist). The system (e.g., monitoring device and/or signal transmitting unit) can coordinate that traffic so that it is routed between the vehicles, delivered, and then any response routed back again.

With certain systems, such as Ethernet over MU systems, any traffic that comes into the Ethernet port of the consist is sent to all the other Ethernet over MU devices, whether desired or not. In contrast to this, the present invention only routes traffic that is destined for another locomotive (or other vehicle), instead of all traffic.

FIG. 7 is a schematic diagram of a system 220 for managing network services among locomotives in a consist. The consist includes a first available device 222 positioned in a first locomotive 224 in the consist, and a second available device 226 positioned in a second locomotive 228 in the consist. The first and second available devices 222, 226 are substantially equivalent in function. The system comprises a monitoring device 230 configured for deployment on one of the locomotives in the consist and to communicate with the first and second available devices 222, 226. The monitoring device is further configured to determine respective operational statuses of the first and second available devices 222, 226. The system further comprises a signal transmitting device 232 configured to communicate with the first and second available devices 222, 226 and configured to route data traffic to one of the first available device 222 or the second available device 226 when the monitoring unit 230 determines that the other of the first available device or the second available device is in a failure state. As discussed above, in an embodiment, the monitoring unit and the signal transmitting device may be a controller or a computer.

Figure 8:
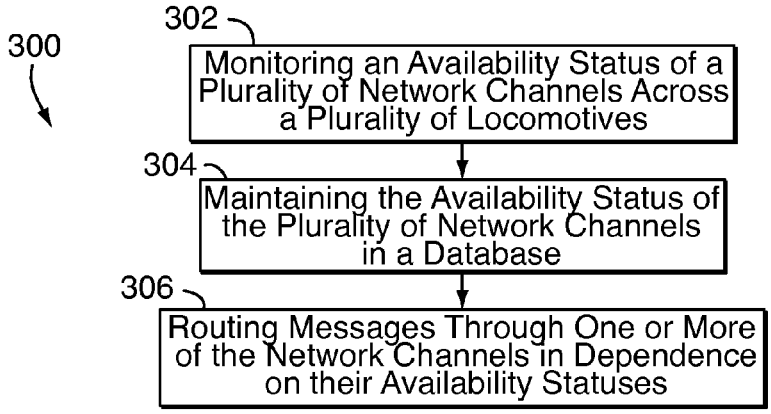
FIG. 8 is a flowchart illustrating an exemplary method for managing a high-availability network for a locomotive consist, according to an embodiment of the present invention.
Figure 9:
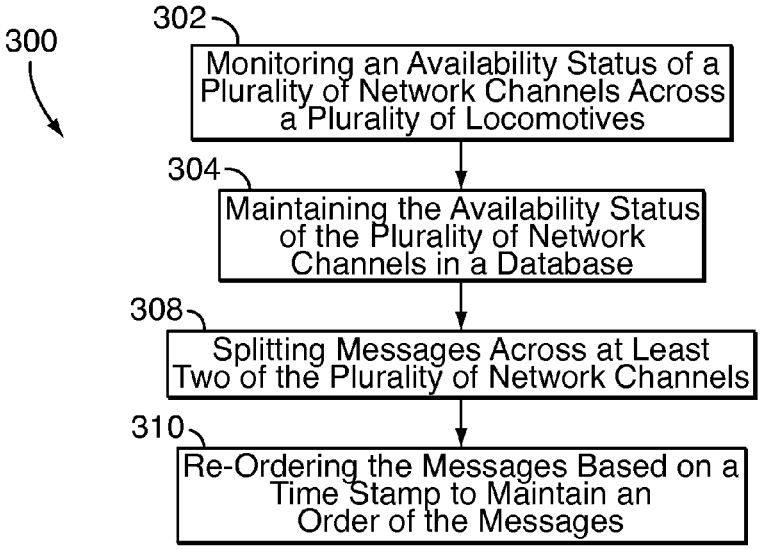
FIG. 9 is a flowchart illustrating an exemplary method for managing a high-availability network for a locomotive consist, according to another embodiment of the present invention.

Yet other embodiments of the present invention relate to a high-availability data network for a vehicle consist, and a method for creating and maintaining the same. FIGS. 8 and 9 illustrate exemplary methods for managing a high-availability network for a locomotive consist or other vehicle consist. In an embodiment, multiple networks are first created by any one or more of separate physical pathways (e.g., separate trainline wires or other separate cables/conductors), different network keys that allows traffic separation but network coordination between transmissions, and/or utilization of different encryption technologies so the networks are separate but such that there is no coordination of traffic between devices. In an embodiment, once the hardware (e.g., Ethernet bridges such as Ethernet over MU router transceiver units) for the network is established, then it is configured to use the different network keys or different encryption technologies to create the high-availability network. In another embodiment, the high-availability network may be constructed by running separate Ethernet bridge (e.g., Ethernet over MU) lines adjacent one another.

In connection with the above, in an embodiment, the present invention relates to a method for determining which types of networks are available such that traffic can be routed to the correct locomotives or other vehicles in the consist. Similar to the embodiment described above, at least one electronic component monitors an operational status of the network channels of each locomotive (or other vehicle) in the consist, such as at step 302. The lead locomotive (or another designated vehicle) maintains a database/routing list of what networks/channels are available and operational across each locomotive (or other vehicle) in the consist and which are non-operational, such as at step 304, so that traffic can be routed across the consist, at step 306, to desired locomotives or other vehicles accordingly, as discussed hereinafter.

First, if a locomotive or other vehicle is present that has only one available network or network channel, i.e., the network channel is not redundant, then communications/traffic that are sent and received by the devices on such vehicle occurs on this network or network channel. Accordingly, because the routing list knows that the device on this locomotive or other vehicle only has a single available network or network channel, this network or channel is automatically selected for any traffic to that particular vehicle/device.

In an embodiment, for locomotives or other vehicles that have more than one available channel/network, the traffic to devices on such locomotives, or across such locomotives, may be split across both paths, at step 308, and re-ordered at step 310 based on time stamp so that no out of order messaging occurs.

In another embodiment, the system may be configured such that messages/traffic are always sent across a primary network or network channel(s), with status check messages between network communication devices (e.g., router transceiver units) to check the integrity of a secondary network or network channel(s) so that messages/traffic may be switched over to the secondary network or network channel(s) with a high degree of confidence that it is actually available.

In an embodiment, management of the high-availability network involves keeping track of the communications networks/network channel(s) that are available across each locomotive (or other vehicle) in the consist, from both a configuration and operation standpoint. If a locomotive (or other vehicle) does not have a high-availability option, i.e., only a single network/network channel is operational, then traffic will always be routed down that particular channel, as discussed above. In contrast, if a locomotive or other vehicle does have another network/network channel, an available device will periodically check for the operability of the alternate network or channel, as well as notify the lead locomotive (or other designated vehicle of the consist, e.g., network lead vehicle) of the success or failure (operability or non-operability) of that channel. Traffic that may appear back at the source over the other channel(s) accidentally may also be filtered out of the overall traffic that is supposed to be received, by analyzing the packets' routing information.

Figure 10:
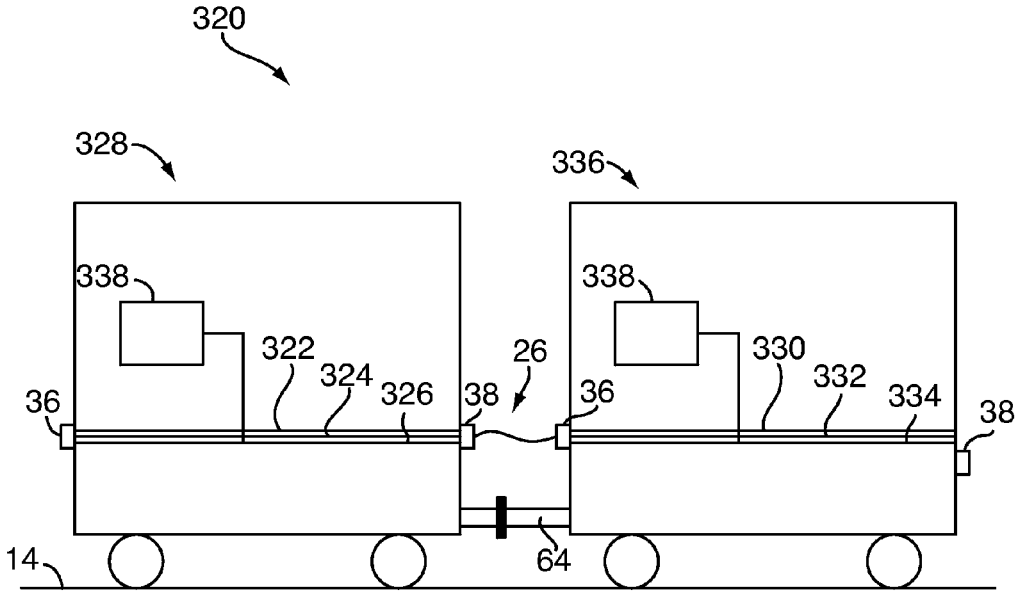
FIG. 10 is a schematic diagram of a system for managing a high-availability network for a locomotive consist, according to an embodiment of the present invention.

FIG. 10 is a schematic diagram of a system 320 for managing network services among locomotives in a consist. As shown therein, the system 320 includes a first plurality of communication channels (or networks), e.g., channels 322, 324, 326, associated with a first locomotive 328, a second plurality of communication channels (or networks), e.g., channels 330, 332, 334 associated with a second locomotive 336, and a routing unit 338 configured to communicate over the first and second pluralities of communication channels (322, 324, 326 and 330, 332, 334). The routing unit 338 is configured for routing a message through at least one of the first plurality of communication channels 322, 324, 326 of the first locomotive 328 or at least one of the second plurality of channels 330, 332, 334 of the second locomotive 336 in dependence upon respective operational statuses of the first and second pluralities of communication channels (322, 324, 326 and 330, 332, 334).

Figure 11:
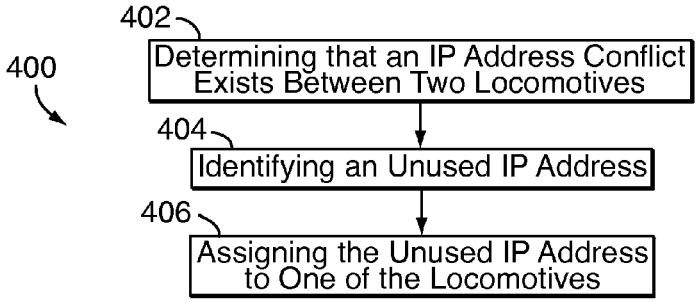
FIG. 11 is a flowchart illustrating an exemplary method for resolving a conflict between IP addresses of locomotives in a consist, in accordance with an embodiment of the present invention.
Figure 12:
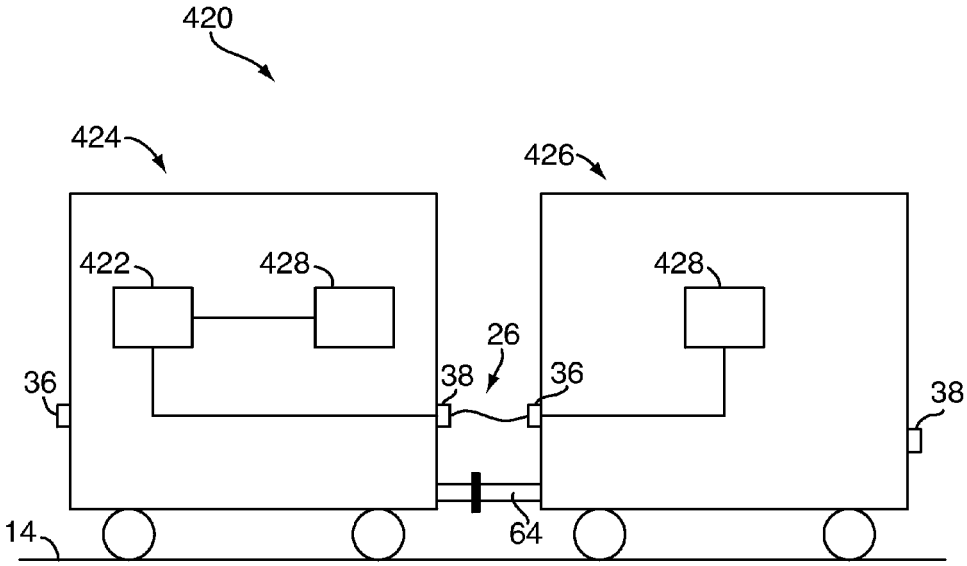
FIG. 12 is a schematic diagram of a system for resolving a conflict between IP addresses of locomotives in a consist, in accordance with an embodiment of the present invention.

As shown in FIGS. 11 and 12, other embodiments of the present invention to relate to a method and system for handling IP addressing (or other network addressing) between multiple train networks or multiple locomotives (or other vehicles) in a consist having the same IP address or other network address. As will be readily appreciated, when a locomotive is connected to another locomotive, it is possible that the locomotives will have the same IP address (static or dynamic). In order to have locomotives with the same IP address co-exist on the same network, in embodiments, an IP address configuration method is utilized to resolve the conflict.

In an embodiment, a method for configuring IP addresses for locomotives in a consist includes utilizing fixed but configurable IP addresses so that the locomotives can all be on the same subnet (e.g., WAN-type subnet). As will be readily appreciated, this will allow for communications between locomotives as long as they are routed to the same subnet. In the method, for the last octet of the IP address, a locomotive will use a MAC address entry (e.g., fixed) to translate and determine the last octet. For example, a MAC address of xx-xx-xx-xx-10 would correspond to using an IP address of xxx.xxx.xxx.16. In another embodiment, the locomotive train ID may be utilized, however, conflicts may still manifest. Accordingly, in order to resolve duplicates in train ID items, a customer number may be used.

In any event, it is possible that IP address conflicts between locomotives in a consist may still be encountered. Accordingly, the present invention also relates to a method for resolving a conflict between IP addresses of locomotives. FIG. 11 illustrates an exemplary method 400 for resolving a conflict between IP addresses of locomotives in a consist. The method includes the steps of determining that a first locomotive in the consist has an IP address that is the same as the IP address of a second locomotive in the consist (step 402), identifying an unused IP address (step 404), and assigning the unused IP address to either the first locomotive or the second locomotive (step 406). An unused IP address may be identified by listening for an unused IP address on the channel.

In another embodiment, the conflict may be resolved by using a different MAC address entry for the IP address determination in event of a conflict for the conflicting locomotives. In another embodiment, the IP address conflict may be resolved by using signal level or any other dynamic but specific factor in determining a difference between the Ethernet over MU units so it can be decided which locomotive should move to another IP address.

FIG. 12 is a schematic diagram of a system 420 for resolving a conflict between IP addresses of locomotives in a consist. As shown therein, the system includes a conflict determination module 422 configured for deployment on and/or in communication with a first locomotive 424 having a first IP address and a second locomotive 426 having a second IP address, and configured to determine that the first IP address is the same as the second IP address and a controller 428 configured for deployment on at least one of the first locomotive 404 and the second locomotive 426 and further configured for identifying an unused IP address. The controller 428 or other available device is capable of assigning the unused IP address to one of the first locomotive 424 and the second locomotive 406. In an embodiment, the controller 428 may function as the conflict determination module 422.

An embodiment relates to a communication method for a consist comprising a plurality of vehicles. The method comprises linking the plurality of vehicles to establish a data network. For example, linking may include communicating over a communications path established between the vehicles, according to established protocols, in a manner that is designated for establishing the data network. The method further comprises designating a first vehicle of the plurality of vehicles as a network lead vehicle of the data network. The method further comprises designating a second vehicle of the plurality of vehicles as a network trail vehicle of the data network. The method further comprises communicating network data between the plurality of vehicles based at least in part on the first vehicle designated as the network lead vehicle and the second vehicle designated as the network trail vehicle.

In another embodiment, the method further comprises controlling operations of at least one of the plurality of vehicles based on the network data that is communicated.

In another embodiment, the method further comprises designating all vehicles of the plurality of vehicles other than the first vehicle as network trail vehicles and communicating the network data between the plurality of vehicles based at least in part on said all vehicles of the plurality of vehicles other than the first vehicle designated as the network trail vehicles.

In another embodiment of the method, the first vehicle is designated as the network lead vehicle based on one or more positions of one or more of the vehicles in the consist.

In another embodiment of the method, the first vehicle is designated as the network lead vehicle based on the first vehicle being a leading vehicle of the consist in a designated direction of travel of the consist.

In another embodiment of the method, the first vehicle is designated as the network lead vehicle based on a sequence of vehicles added to the consist.

In another embodiment of the method, the steps of designating the first vehicle as the network lead vehicle and designating the second vehicle as the network trail vehicle are carried out automatically subsequent to the plurality of vehicles being linked to establish the data network.

In another embodiment of the method, the step of designating the first vehicle as the network lead vehicle comprises configuring the first vehicle for operations as the network lead vehicle and communicating status information indicative of the first vehicle designated as the network lead vehicle to the second vehicle, and configuring the second vehicle for operations as the network trail vehicle.

In another embodiment, the method further comprises the first vehicle, responsive to the designation of the first vehicle as the network lead vehicle, at least one of configuring plural services available to entities in the data network or coordinating data traffic in the data network.

In another embodiment of the method, configuring the plural services comprises at least one of storing, creating, or updating at least one master routing table of the services.

In another embodiment, the method further comprises the first vehicle transitioning services between the plurality of vehicles.

In another embodiment, the method further comprises the first and second vehicles communicating setup data to one another. The first vehicle is designated as the network lead vehicle and the second is designated as the network trail vehicle based at least in part on the setup data. The step of communicating the setup data is carried out automatically subsequent to the plurality of vehicles being linked to establish the data network.

In another embodiment, the method further comprises, subsequent to a third vehicle being added to the consist:

communicating setup data at least between the third vehicle and the first vehicle; and based on the setup data, either: designating the third vehicle as an additional network trail vehicle of the data network; or designating the third vehicle as the network lead vehicle in conjunction with designating the first vehicle as an additional network trail vehicle of the data network.

In an embodiment where the vehicles are rail vehicles (e.g., locomotives) in a rail vehicle consist, a communication method comprises linking the plurality of rail vehicles (e.g., locomotives) to establish a data network. The method further comprises designating a first rail vehicle (e.g., a first locomotive) of the plurality of rail vehicles (e.g., locomotives) as a network lead rail vehicle (e.g., network lead locomotive) of the data network. The method further comprises designating a second rail vehicle (e.g., a second locomotive) of the plurality of locomotives or other rail vehicles as a network trail rail vehicle (e.g., network trail locomotive) of the data network. The method further comprises communicating network data between the plurality of rail vehicles (e.g., locomotives) based at least in part on the first rail vehicle (e.g., first locomotive) designated as the network lead rail vehicle (e.g., network lead locomotive) and the second rail vehicle (e.g., second locomotive) designated as the network trail rail vehicle (e.g., network trail locomotive).

In another embodiment, the method further comprises controlling operations of at least one of the plurality of rail vehicles (e.g., locomotives) based on the network data that is communicated.

In another embodiment, the method further comprises designating all rail vehicles (e.g., locomotives) of the plurality of rail vehicles (e.g., locomotives) other than the first rail vehicle (e.g., first locomotive) as network trail rail vehicles (e.g., network trail locomotives) and communicating the network data between the plurality of rail vehicles (e.g., locomotives) based at least in part on said all rail vehicles (e.g., locomotives) of the plurality of rail vehicles (e.g., locomotives) other than the first rail vehicle (e.g., first locomotive) designated as the network trail rail vehicles (e.g., network trail locomotives).

In another embodiment of the method, the first rail vehicle (e.g., first locomotive) is designated as the network lead rail vehicle (e.g., network lead locomotive) based on one or more positions of one or more of the rail vehicles (e.g., locomotives) in the consist.

In another embodiment of the method, the first rail vehicle (e.g., first locomotive) is designated as the network lead rail vehicle (e.g., network lead locomotive) based on the first rail vehicle (e.g., first locomotive) being a leading rail vehicle (e.g., leading locomotive) of the consist in a designated direction of travel of the consist.

In another embodiment of the method, the first rail vehicle (e.g., first locomotive) is designated as the network lead rail vehicle (e.g., network lead locomotive) based on a sequence of rail vehicles (e.g., locomotives) added to the consist.

In another embodiment of the method, the steps of designating the first rail vehicle (e.g., first locomotive) as network lead rail vehicle (e.g., network lead locomotive) and designating the second rail vehicle (e.g., second locomotive) as the network trail rail vehicle (e.g., network trail locomotive) are carried out automatically subsequent to the plurality of rail vehicles (e.g., locomotives) being linked to establish the data network.

In another embodiment of the method, the step of designating the first rail vehicle (e.g., first locomotive) as the network lead rail vehicle (e.g., network lead locomotive) comprises configuring the first rail vehicle (e.g., first locomotive) for operations as the network lead rail vehicle (e.g., network lead locomotive) and communicating status information indicative of the first rail vehicle (e.g., first locomotive) designated as the network lead rail vehicle (e.g., network lead locomotive) to the second rail vehicle (e.g., second locomotive), and configuring the second rail vehicle (e.g., second locomotive) for operations as the network trail rail vehicle (e.g., network trail locomotive).

In another embodiment, the method further comprises the first rail vehicle (e.g., first locomotive), responsive to the designation of the first rail vehicle (e.g., first locomotive) as the network lead rail vehicle (e.g., network lead locomotive), at least one of configuring plural services available to entities in the data network or coordinating data traffic in the data network. In another embodiment of the method, configuring the plural services comprises at least one of storing, creating, or updating at least one master routing table of the services.

In another embodiment, the method further comprises the first rail vehicle (e.g., first locomotive) controlling transitioning services between the plurality of rail vehicles (e.g., locomotives).

In another embodiment, the method further comprises the first and second rail vehicles (e.g., first and second locomotives) communicating setup data to one another. The first rail vehicle (e.g., first locomotive) is designated as the network lead rail vehicle (e.g., network lead locomotive) and the second is designated as the network trail rail vehicle (e.g., network trail locomotive) based at least in part on the setup data. The step of communicating the setup data is carried out automatically subsequent to the plurality of rail vehicles (e.g., locomotives) being linked to establish the data network.

In another embodiment, the method further comprises, subsequent to a third locomotive or other rail vehicle being added to the consist: communicating setup data at least between the third locomotive (or other rail vehicle) and the first rail vehicle (e.g., first locomotive); and based on the setup data, either: designating the third locomotive (or other rail vehicle) as an additional network trail rail vehicle (e.g., additional network trail locomotive) of the data network; or designating the third locomotive (or other rail vehicle) as the network lead rail vehicle (e.g., network lead locomotive) in conjunction with designating the first rail vehicle (e.g., first locomotive) as an additional network trail rail vehicle (e.g., additional network trail locomotive) of the data network.

Another embodiment relates to a communication system (e.g., for a vehicle consist) comprising a first controller unit configured for operative coupling in a first vehicle. The first controller unit is configured, when the first vehicle is linked with one or more second vehicles in a data network of a consist, to designate one of the first vehicle or one of the one or more second vehicles as a network lead vehicle of the data network and to designate all other vehicles in the consist as network trail vehicles of the data network. The first controller unit is further configured to control communications of network data between the first vehicle and the one or more second vehicles based at least in part on the network lead vehicle and network trail vehicle designations.

In another embodiment of the communication system, the first controller unit is configured to designate the network lead vehicle and the network trail vehicles according to at least one parameter of the consist. The at least one parameter comprises one or more of a position of the first vehicle relative to the one or more second vehicles in the consist, a sequence of vehicles added to the consist, or an identification of which vehicle in the consist is a leading vehicle of the consist in a designated direction of travel.

In another embodiment of the communication system, the first controller unit is configured to automatically control communication of setup data between the first vehicle and the one or more second vehicles subsequent to establishment of the data network in the consist. The first controller unit is configured to designate the network lead vehicle and the network trail vehicles based at least in part on the setup data. In another embodiment of the communication system, the first controller unit is configured to designate the network lead vehicle and the network trail vehicles according to at least one parameter of the consist. Further, information of the parameter is included in the setup data, and the at least one parameter comprises one or more of a position of the first vehicle relative to the one or more second vehicles in the consist, a sequence of vehicles added to the consist, or an identification of which vehicle in the consist is a leading vehicle of the consist in a designated direction of travel.

In another embodiment of the communication system, the first controller is configured, when the first vehicle is designated as the network lead vehicle, to at least one of configure plural services available to entities in the data network or coordinate data traffic in the data network.

Another embodiment relates to a communication system (e.g., for a train or other rail vehicle consist) comprising a first controller unit configured for operative coupling in a first rail vehicle (e.g., a first locomotive). The first controller unit is configured, when the first rail vehicle (e.g., first locomotive) is linked with one or more second rail vehicles (e.g., one or more second locomotives) in a data network of a consist, to designate one of the first rail vehicle (e.g., first locomotive) or one of the one or more second rail vehicles (e.g., one of the one or more second locomotives) as a network lead rail vehicle (e.g., network lead locomotive) of the data network and to designate all other rail vehicles (e.g., locomotives) in the consist as network trail rail vehicles (e.g., network trail locomotives) of the data network. The first controller unit is further configured to control communications of network data between the first rail vehicle (e.g., first locomotive) and the one or more second rail vehicles (e.g., one or more second locomotives) based at least in part on the network lead rail vehicle (e.g., network lead locomotive) and network trail rail vehicle (e.g., network trail locomotive) designations.

In another embodiment of the communication system, the first controller unit is configured to designate the network lead rail vehicle (e.g., network lead locomotive) and the network trail rail vehicles (e.g., network trail locomotives) according to at least one parameter of the consist. The at least one parameter comprises one or more of a position of the first rail vehicle (e.g., first locomotive) relative to the one or more second rail vehicles (e.g., one or more second locomotives) in the consist, a sequence of rail vehicles (e.g., locomotives) added to the consist, or an identification of which locomotive or other rail vehicle in the consist is a leading locomotive or other rail vehicle of the consist in a designated direction of travel.

In another embodiment of the communication system, the first controller unit is configured to automatically control communication of setup data between the first rail vehicle (e.g., first locomotive) and the one or more second rail vehicles (e.g., one or more second locomotives) subsequent to establishment of the data network in the consist. The first controller unit is configured to designate the network lead rail vehicle (e.g., network lead locomotive) and the network trail rail vehicles (e.g., network trail locomotives) based at least in part on the setup data. In another embodiment of the communication system, the first controller unit is configured to designate the network lead rail vehicle (e.g., network lead locomotive) and the network trail rail vehicles (e.g., network trail locomotives) according to at least one parameter of the consist. Further, information of the parameter is included in the setup data, and the at least one parameter comprises one or more of a position of the first rail vehicle (e.g., first locomotive) relative to the one or more second rail vehicles (e.g., one or more second locomotives) in the consist, a sequence of rail vehicles (e.g., locomotives) added to the consist, or an identification of which locomotive or other rail vehicle in the consist is a leading locomotive or other rail vehicle of the consist in a designated direction of travel.

In another embodiment of the communication system, the first controller is configured, when the first rail vehicle (e.g., first locomotive) is designated as the network lead rail vehicle (e.g., network lead locomotive), to at least one of configure plural services available to entities in the data network or coordinate data traffic in the data network.

In another embodiment of a communication system, the communication system comprises a first controller unit configured for operative coupling in a first vehicle. The first controller unit is configured, when the first vehicle is linked with one or more second vehicles in a data network of a consist, to enter a first designated mode of operation responsive to communications between the first vehicle and the one or more second vehicles for selecting the first vehicle to operate in the first designated mode of operation and the one or more second vehicles to operate in a different, second designated mode of operation. The first controller unit is further configured, when in the first designated mode of operation, to at least one of: coordinate data traffic in the data network of the consist; and/or configure and manage services available to plural entities of the data network of the consist.

In another embodiment of a communication system, the communication system comprises a first controller unit configured for operative coupling in a first locomotive or other first rail vehicle. The first controller unit is configured, when the first locomotive (or other first rail vehicle) is linked with one or more second vehicles (e.g., one or more second locomotives) in a data network of a consist, to enter a first designated mode of operation responsive to communications between the first locomotive (or other first rail vehicle) and the one or more second rail vehicles (e.g., one or more second locomotives) for selecting the first rail vehicle (e.g., first locomotive) to operate in the first designated mode of operation and the one or more second rail vehicles (e.g., one or more second locomotives) to operate in a different, second designated mode of operation. The first controller unit is further configured, when in the first designated mode of operation, to at least one of: coordinate data traffic in the data network of the consist; and/or configure and manage services available to plural entities of the data network of the consist.

In an embodiment, a method for communications in a vehicle consist (e.g., a locomotive or other rail vehicle consist) comprises determining that a first vehicle in the vehicle consist (e.g., a first locomotive or other first rail vehicle) has a network address (e.g., a first IP address) that is the same as a network address (e.g., a second IP address) of a second vehicle in the vehicle consist (e.g., a second locomotive or other second rail vehicle). The method further comprises identifying a first unused network address (e.g., generating, calculating, determining, or the like), and communicating signals for assignment of the first unused network address to one of the first vehicle or the second vehicle. By referring to a vehicle having a network address, this includes: the vehicle itself having the network address associated with the vehicle; and/or that a component of the vehicle capable of network communications has the network address assigned, determined, or otherwise associated with it.

In another embodiment, the method further comprises assigning the network address of the first vehicle and/or the network address of the second vehicle based on a first MAC (media access control) address associated with a data network of the vehicle consist. (In other words, according to one aspect, the first and second network addresses may be initially generated based on the first MAC address.) The unused network address is identified based on a different, second MAC address associated with the data network.

In another embodiment, the method further comprises identifying a second unused network address based on the second MAC address, and communicating second signals for assignment of the second unused network address to the other of the one of the first vehicle or the second vehicle (i.e., to whichever of the vehicles was not assigned the first unused network address).

In another embodiment, the method further comprises determining a difference between dynamic (i.e., changing or changeable) operational states of network equipment (e.g., signal levels) of the first vehicle and network equipment of the second vehicle. The first unused network address is determined based at least in part on the difference that is determined.

In another embodiment, the method further comprises determining a difference between dynamic operational states of network equipment of the first vehicle and network equipment of the second vehicle, wherein the first vehicle or the second vehicle to which the first unused network address is assigned is selected based at least in part on the difference that is determined.

In another embodiment, the method further comprises assigning the network address of the first vehicle and/or the network address of the second vehicle based at least in part on at least one vehicle identifier associated with at least one of the first vehicle or the second vehicle. For example, the vehicle identifiers may be locomotive road numbers, automobile VIN's, fleet numbers, license plate numbers, or the like.

In another embodiment, the method further comprises communicating data to the first vehicle and/or to the second vehicle based on the first unused network address assigned to the first vehicle or the second vehicle and on the network address of the other of the first vehicle or the second vehicle.

In another embodiment, the method further comprises controlling the vehicle consist for movement along a route based on the data that is communicated to the first vehicle and/or the second vehicle.

In another embodiment, the first unused network address that is assigned to the first vehicle or the second vehicle and the network address of the other of the first vehicle or the second vehicle are associated with a same subnet (e.g., WAN-type subnet) of a data network of the vehicle consist.

In another embodiment, the first unused network address is identified by listening to a channel of a data network of the vehicle consist (e.g., processing incoming data indicative that the unused network address is available).

In another embodiment, a method for communications in a vehicle consist (e.g., a locomotive or other rail vehicle consist) comprises determining (e.g., calculating, identifying, allocating, or the like) a first network address (e.g., a first IP address) for a first vehicle in the vehicle consist (e.g., a first locomotive or other first rail vehicle) and a second network address (e.g., a second IP address) for a second vehicle in the vehicle consist (e.g., a second locomotive or other second rail vehicle). The first vehicle and the second vehicle are linked in a data network. The method further comprises identifying a conflict between the first network address and the second network address. For example, the conflict might be that the first network address is the same as the second network address. Responsive to identifying the conflict, the method further comprises selecting the first vehicle for network address re-assignment (i.e., one of the first vehicle or the second vehicle is selected, and in this example it is the first vehicle that is selected). The method further comprises determining a third network address that is not in conflict with the second network address of the second vehicle, and assigning the third network address to the first vehicle in place of the first network address. Data is communicated in the data network based at least in part on the second network address and the third network address.

In another embodiment, the first network address and the second network address are determined based on a first MAC address associated with the data network. The third network address is determined based on a different, second MAC address associated with the data network.

In another embodiment, the method further comprises identifying a fourth network address based on the second MAC address, and assigning the fourth network address to the second vehicle in place of the second network address.

In another embodiment, the method further comprises determining at least one of the first network address, the second network address, or the third network address based at least in part on at least one vehicle identifier associated with at least one of the first vehicle or the second vehicle.

In another embodiment, the method further comprises controlling the vehicle consist for movement along a route based on the data that is communicated.

In another embodiment, a method for communications in a vehicle consist (e.g., a locomotive or other rail vehicle consist) comprises determining that a first vehicle in the vehicle consist (e.g., a first locomotive or other first rail vehicle) has a first network address that is the same as a second network address of a second vehicle in the vehicle consist (e.g., a second locomotive or other second rail vehicle). The first vehicle and the second vehicle are linked in a network. The method further comprises identifying an unused network address of the network, and communicating signals for assignment of the unused network address to one of the first vehicle or the second vehicle.

In another embodiment of the method, the determining step is automatically carried out responsive to when the first and second vehicles are linked and communicate to establish the network.

In another embodiment, the method further comprises, at the one of the first vehicle or the second vehicle to which the signals are communicated, using the unused network address in place of the first network address or the second network address, as applicable, for communications in the network.

In another embodiment, a method for communications in a vehicle consist (e.g., a locomotive or other rail vehicle consist) comprises generating first and second network addresses for first and second vehicles in the consist, respectively, based on at least one of vehicle identifiers respectively associated with the first and second vehicles and/or a first MAC address associated with a data network. (The vehicles of the vehicle consist are linked to form the data network, for data communications with the consist.) The method further comprises, if the first and second network addresses are the same: generating third and fourth network addresses for the first and second vehicles, respectively, based on a different, second MAC address associated with the data network (e.g., the third and fourth network addresses are used in place of the first and second network addresses); and/or determining a third network address that is different from the first and second network addresses, and assigning the third network address to the first vehicle or to the second vehicle.

Another embodiment relates to a system for communications in a vehicle consist (e.g., a locomotive or other rail vehicle consist). The system comprises a conflict determination module configured for communication with a first vehicle (e.g., a first locomotive or other first rail vehicle) having a first network address (e.g., a first IP address) and a second vehicle (e.g., a second locomotive or other second rail vehicle) having a second network address (e.g., a second IP address). The conflict determination module is further configured to determine if the first network address is the same as the second network address. The system further comprises a control module configured for deployment on at least one of the first vehicle or the second vehicle and further configured to identify an unused network address. The control module is configured to assign the unused network address to one of the first vehicle or the second vehicle if the conflict determination module determines that the first network address is the same as the second network address.

In another embodiment of the system, the conflict determination module and the control module are integrated into a single unit.

In another embodiment of the system, the unused network address is identified (e.g., determined, generated, or the like) and/or assigned at least in part by one or more of the following: assessing communications of data on a channel of the network for the unused network address; using a different MAC address entry for identifying the unused network address in event of a conflict for the conflicting vehicles; and/or using signal level or any other dynamic but designated factor in determining which of the first or second vehicles to communicate the signals to for assignment of the unused network address.

As noted, in any of the embodiments, the network addresses may be IP addresses.

Another embodiment relates to a communication method. The method comprises, in a vehicle consist comprising a plurality of vehicles connected in a data network, storing in a first vehicle of the consist a list of available services that are available across one or more of the vehicles of the consist connected in the data network. For example, the services may comprise functions that can be performed by available devices of the network, which process, communicate, or otherwise use network data. (As noted above, "available" service or device refers to a service or device that is operably connected for potentially using network data that is communicated in the data network, not necessarily that the service or device is currently operational for doing so.) The method further comprises, at the first vehicle, communicating first information of the list of available services to other vehicles in the consist.

In another embodiment, the communication method further comprises, at the first vehicle, receiving second information of the available services, and creating and/or revising the list based on the received second information.

In another embodiment, the communication method further comprises, at the first vehicle, periodically transmitting control signals to other vehicles in the consist, and receiving the second information responsive to the control signals.

In another embodiment, the communication method further comprises one or more of the vehicles in the consist periodically transmitting the second information to the first vehicle.

In another embodiment, the communication method further comprises routing data within the data network of the vehicle consist based on the list of available services. The method may further comprise controlling the vehicle consist for travel along a route based at least in part on the data.

In another embodiment, the communication method further comprises receiving a request for the list of available services from a network device in the consist, and communicating the first information to the network device responsive to receiving the request.

In another embodiment, the communication method further comprises storing information of available devices that are available across one or more of the vehicles of the consist connected in the data network.

In another embodiment, the communication method further comprises storing, for one or more of the available services, respective failover information indicative of services and/or devices in the data network that are substantially equivalent to the one or more of the available services. The method further comprises routing data based on the failover information if one of the one or more available services ceases to become available. The data may be routed to a different vehicle in the consist than a designated recipient vehicle of the consist (i.e., the data may be routed to a vehicle other than the vehicle to which the data is addressed).

In another embodiment, the communication method further comprises monitoring plural available devices of the vehicles of the consist to determine respective operational statuses of the available devices, and maintaining the list of available services based at least in part on the operational statuses of the available devices that are monitored.

In another embodiment of a communication method in a vehicle consist comprising a plurality of vehicles linked together in a data network, the method comprises monitoring plural available devices of the vehicles in the consist to determine respective operational statuses of the plural available devices. The method further comprises maintaining information of the operational statuses of the plural available devices in a database, and communicating the information of the operational statuses to the plural vehicles in the consist.

In another embodiment, the communication method further comprises routing data in the data network of the vehicle consist based at least in part on the information of the operational statuses of the plural available devices. For example, the data may be routed to a second, substantially equivalent available device of the consist if a first available device to which the data is addressed is non-operational.

In another embodiment of the communication method, monitoring the plural available devices of the vehicles in the consist comprises receiving information relating to the plural available devices from the vehicles. Additionally or alternatively, the information of the operational statuses may be communicated to the plural vehicles in the consist responsive to receiving requests from the plural vehicles.

In another embodiment of a communication method in a vehicle consist comprising a plurality of vehicles linked together in a data network, the method comprises receiving information of respective operational statuses of plural available devices and/or services of the vehicles in the consist. The method further comprises maintaining information of the operational statuses of the plural available devices and/or services in a database, communicating the information of the operational statuses to the plural vehicles in the consist, and routing data in the data network based at least in part on the information of the operational statuses.

Another embodiment relates to a communication system. The system comprises a monitoring device configured for deployment on board a vehicle consist having a plurality of vehicles linked together in a data network. The monitoring device is further configured to communicate with plural available devices of the vehicles for determining respective operational statuses of the available devices. The monitoring device is further configured to store information of the operational statuses of the available devices (e.g., the information may be stored in a database that is operably coupled to the monitoring device). The system further comprises a signal transmitting device configured for deployment on board the vehicle consist, and further configured to communicate the information of the operational statuses of the available devices to the plural vehicles and/or to route network data based on the information of the operational statuses of the available devices.

In another embodiment of the communication system, the signal transmitting device is configured to route the network data to a substantially equivalent device of the plural available devices if an available device to which the network data is addressed enters a failure state. As noted above, failure state menas incapable of performing a designated function at all, or incapable of performing the designated function above designated performance level threshold(s).

In another embodiment of the communication system, the monitoring device is a simple network management protocol (SNMP) supported router.

Another embodiment relates to a method for communications in a vehicle consist. The method comprises monitoring respective operational statuses of a plurality of network channels across a plurality of vehicles in the consist, and routing messages through one or more of the network channels in dependence upon the monitored operational statuses of the network channels.

In another embodiment of the method, the plurality of network channels comprises at least one channel of a first network and at least one channel of a second network. The first and second networks are at least logically distinct.

In another embodiment of the method, the first network and the second network are established by way of at least one of: the first network having a first physical pathway that is different than a second physical pathway of the second network; the first network having a first network key that is different than a second network key of the second network; and/or the first network having a first data encryption that is different than a second data encryption of the second network.

In another embodiment, the method further comprises splitting the messages across the plurality of network channels, and re-ordering the messages based on a time-stamp to maintain an order of the messages. (In the case of plural networks, the messages are split across the plural network channels of the plural networks.) Splitting includes transmitting some messages across one channel and other messages across other channels, and/or transmitting some data packets of a message across one channel and other data packets of the message across a different, second channel.

In another embodiment, the method further comprises routing the messages through the at least one channel of the first network only, unless the at least one channel of the first network is unavailable, in which case the method comprises routing the messages through the at least one channel of the second network.

In another embodiment, the method further comprises filtering duplicates of the messages and duplicate portions of the messages that are routed over plural of the network channels. More specifically, if in communicating over the plural network channels message and/or packet duplication occurs, duplicate messages and packets are identified and deleted.

In another embodiment, the method further comprises maintaining the operational statuses of the plurality of network channels in a database. In another embodiment, alternatively or additionally, the method further comprises communicating the operational statuses to the plurality of vehicles.

In another embodiment of a method for communications in a vehicle consist, the method comprises monitoring respective operational statuses of a first network and a second network of the vehicle consist. The first and second networks are at least logically distinct. The method further comprises routing messages through the first network and the second network based at least in part on the monitored operational statuses of the first network and the second network.

In another embodiment of the method, if the first network and the second network are operational, the method comprises at least one of routing the messages through the first network only, or splitting the messages for routing over both the first network and the second network. On the other hand, if the first network is non-operational, the messages are routed through the second network.

In another embodiment of the method, the method further comprises re-ordering the messages that are split for routing over both the first network and the second network based on a time-stamp to maintain an order of the messages.

In another embodiment of the method, the method further comprises filtering duplicates of the messages and duplicate portions of the messages that are routed over both the first network and the second network.

In another embodiment of a method for communications in a vehicle consist, the method comprises, at a first vehicle of the vehicle consist, transmitting and/or receiving first signals of a first network established between the first vehicle and one or more second vehicles of the vehicle consist. The method further comprises, at the first vehicle, transmitting and/or receiving second signals of a second network established between the first vehicle and one or more second vehicles of the vehicle consist. The first and second networks are at least logically distinct. In another embodiment, a system comprises a communication unit comprising one or more hardware and/or software modules configured for transmitting and/or receiving first and second signals according to: at a first vehicle of the vehicle consist, transmitting and/or receiving first signals of a first network established between the first vehicle and one or more second vehicles of the vehicle consist; and at the first vehicle, transmitting and/or receiving second signals of a second network established between the first vehicle and one or more second vehicles of the vehicle consist.

In another embodiment of the method, the first and second networks have a plurality of network channels, and the method further comprises monitoring respective operational statuses of the plurality of network channels across the plurality of vehicles in the consist, and routing messages through one or more of the network channels in dependence upon the monitored operational statuses of the network channels.

In another embodiment, the method further comprises translating the first signals for transmission as the second signals over the second network.

In another embodiment, the method further comprises tracking whether the first network and the second network are operational in the second vehicles, and routing the first signals and/or the second signals based on the tracking.

Another embodiment relates to a system for communications in a vehicle consist. The system comprises a routing unit configured for communication across a first plurality of communication channels associated with a first vehicle of the vehicle consist and a second plurality of communication channels associated with a second vehicle of the vehicle consist. The routing unit is configured for deployment on board one of the first vehicle or the second vehicle. The routing unit is further configured for routing a message through at least one of the first plurality of communication channels and at least one of the second plurality of channels in dependence upon respective operational statuses of the first and second pluralities of communication channels.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the invention, including the best mode, and also to enable any person skilled in the art to practice the embodiments of invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present invention will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described systems and methods without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A communication method comprising:

in a vehicle consist comprising a plurality of vehicles connected in a data network, storing in a first vehicle of the consist a list of available services, the list of available services including plural available services that are available on the first vehicle and plural available services that are available across one or more other vehicles of the consist connected in the data network; and at the first vehicle, communicating first information of the list of available services to the other vehicles in the consist.

2. The method of claim 1, further comprising, at the first vehicle, receiving second information of the available services, and at least one of creating or revising the list based on the received second information.

3. The method of claim 2, further comprising, at the first vehicle, periodically transmitting control signals to other vehicles in the consist, and receiving the second information responsive to the control signals.

4. The method of claim 2, further comprising one or more of the vehicles in the consist periodically transmitting the second information to the first vehicle.

5. The method of claim 1, further comprising routing data within the data network of the vehicle consist based on the list of available services.

6. The method of claim 5, further comprising controlling the vehicle consist for travel along a route based at least in part on the data.

7. The method of claim 1, further comprising receiving a request for the list of available services from a network device in the consist, and communicating the first information to the network device responsive to receiving the request.

8. The method of claim 1, further comprising storing information of available devices that are available across one or more of the vehicles of the consist connected in the data network.

9. The method of claim 1, further comprising:

monitoring plural available devices of the vehicles of the consist to determine respective operational statuses of the available devices; and maintaining the list of available services based at least in part on the operational statuses of the available devices that are monitored.

10. A communication method comprising:

in a vehicle consist comprising a plurality of vehicles connected in a data network, storing in a first vehicle of the consist a list of available services that are available across one or more of the vehicles of the consist connected in the data network;

at the first vehicle, communicating first information of the list of available services to other vehicles in the consist;

storing, for one or more of the available services, respective failover information indicative of services and/or devices in the data network that are substantially equivalent to the one or more of the available services; and routing data based on the failover information if one of the one or more available services ceases to become available.

11. The method of claim 10, wherein routing the data based on the failover information comprises routing the data to a different vehicle in the consist than a designated recipient vehicle of the consist.

12. The method of claim 10, further comprising, at the first vehicle, receiving second information of the available services, and at least one of creating or revising the list based on the received second information.

13. The method of claim 12, further comprising, at the first vehicle, periodically transmitting control signals to other vehicles in the consist, and receiving the second information responsive to the control signals.

14. The method of claim 12, further comprising one or more of the vehicles in the consist periodically transmitting the second information to the first vehicle.

15. The method of claim 10, further comprising receiving a request for the list of available services from a network device in the consist, and communicating the first information to the network device responsive to receiving the request.

16. The method of claim 10, further comprising storing information of available devices that are available across one or more of the vehicles of the consist connected in the data network.

17. The method of claim 10, further comprising:

monitoring plural available devices of the vehicles of the consist to determine respective operational statuses of the available devices; and maintaining the list of available services based at least in part on the operational statuses of the available devices that are monitored.

18. A communication method comprising:

in a vehicle consist comprising a plurality of vehicles connected in a data network, the data network including an MU cable bus interconnecting at least two of the plurality of vehicles, storing in a first vehicle of the consist a list of available services that are available across one or more of the vehicles of the consist connected in the data network;

at the first vehicle, communicating first information of the list of available services to other vehicles in the consist; and routing Ethernet data at least over the MU cable bus based on the list of available services.

19. The method of claim 18 further comprising storing, for one or more of the available services, respective failover information indicative of services and/or devices in the data network that are substantially equivalent to the one or more of the available services, wherein the Ethernet data is routed based on the failover information if one of the one or more available services ceases to become available.

* * * * *